US010081479B2

(12) United States Patent
Lee et al.

(10) Patent No.: US 10,081,479 B2
(45) Date of Patent: Sep. 25, 2018

(54) CONTAINER FOR KEEPING FERMENTED FOOD

(71) Applicant: CJ Cheiljedang Corporation, Seoul (KR)

(72) Inventors: Byung Kook Lee, Seoul (KR); Yoon Seung Nam, Seoul (KR); Kwang Soo Park, Gyeonggi-do (KR); Hae Sun Lee, Seoul (KR); Gyu Hwan Cha, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 89 days.

(21) Appl. No.: 15/216,368

(22) Filed: Jul. 21, 2016

(65) Prior Publication Data

US 2017/0057726 A1 Mar. 2, 2017

(30) Foreign Application Priority Data

Aug. 28, 2015 (KR) ..... 10-2015-0121415

(51) Int. Cl.
*B65D 21/032* (2006.01)
*B65D 81/24* (2006.01)

(52) U.S. Cl.
CPC ..... *B65D 81/245* (2013.01)

(58) Field of Classification Search
CPC ... B65D 81/245; B65D 21/0233; B65D 81/24
(Continued)

(56) References Cited

U.S. PATENT DOCUMENTS 2,507,425 A * 5/1950 Swartout ..... A47J 47/02 126/281
3,463,353 A * 8/1969 Peebles ..... B65D 21/0233 206/514

(Continued)

FOREIGN PATENT DOCUMENTS

CN 1328128 C 4/2005
CN 101502312 A 8/2009

(Continued)

OTHER PUBLICATIONS

1st Office Action, JP Application No. 2016-164912, dated Aug. 1, 2017, 2 pages (No English Translation).

(Continued)

*Primary Examiner* — Stephen Castellano
(74) *Attorney, Agent, or Firm* — Swanson & Bratschun, L.L.C.

(57) ABSTRACT

The present invention relates to a container for keeping fermented food, having for example, a main body for accommodating fermented food in an interior space; a pressing plate coming into contact with the surface of the fermented food in the main body; and a cover for blocking the opening of inside of the main body; wherein the main body has a stepped part protruded inwards from the inner circumferential surface of a neck part at an upper end portion, and the pressing plate has a protruded rim provided to the periphery of the upper end portion thereof so as to be placed on the stepped part, a vertical section provided to the lower end of the protruded rim and having an outer circumferential surface coming into contact with the inner circumferential surface of the stepped part, and a round surface provided at the lower end of the vertical section and having a bottom surface part coming into contact with the surface of the fermented food.

9 Claims, 6 Drawing Sheets

(58) Field of Classification Search
USPC ..... 220/629, 630, 529, 23.88, 23.87, 23.86, 220/23.83
See application file for complete search history.

(56) References Cited

U.S. PATENT DOCUMENTS

| | | | | |
|---|---|---|---|---|
| 4,319,679 | A * | 3/1982 | Gustafsson | B01D 53/261 206/0.5 |
| 5,065,923 | A * | 11/1991 | Hoefer | A47G 19/30 141/320 |
| 2013/0087954 | A1* | 4/2013 | Tsuchiya | B29C 49/185 264/531 |

FOREIGN PATENT DOCUMENTS

| | | | |
|---|---|---|---|
| KR | 10-2007-0102195 | | 10/2007 |
| TW | 201520143 | A | 6/2015 |

OTHER PUBLICATIONS

Office Action-Application No. TW105123911, dated Dec. 30, 2016, 8 pages, with Eng. Translation.
Notice of Second Office Action, Japanese Application No. 2016-164912, dated Apr. 26, 2018, mailed May 8, 2018, machine translation, 6 pages.
Chinese First Office Action Notice, Application No. 201610730053.8, dated Nov. 17, 2017, English Translation, 10 pages.

* cited by examiner

CONTAINER FOR KEEPING FERMENTED FOOD

RELATED APPLICATION

This application claims priority to Korean Application Serial No. 10-2015-0121415, filed on Aug. 28, 2015, the content of which is incorporated here by reference in its entirety.

BACKGROUND OF THE INVENTION

Field of the Invention

The present invention relates to a container for keeping fermented food and, more particularly, to a container for keeping fermented food for preventing the spoilage of the fermented food surface due to the movement of a pressing plate, which comes into contact with the fermented food surface in a main body, by restraining the movement of the pressing plate.

Background Art

When food comes into contact with air, the food can be contaminated by impurities such as dust and the like contained in the air and spoilage thereof can accompany due to the rancidity and the like.

Therefore, food has been stored using a container, which includes a main body and a cover, at home, in restaurants, manufacturers and the like.

That is, the food is put in the main body of the container and stored in a state, in which the contact between the food and the air is blocked.

However, even though the food is stored using such a container, the food surface in the main body may come into contact with the air such that the food surface may spoil if the air is introduced into the main body through a gap between the cover and the main body. In particular, in the case of storing fermented food such as kimchi and the like, the surface of this fermented food may more easily spoil due to the activation of microorganisms.

For this reason, an additional "pressing plate" has been provided to the inside of a container for keeping fermented food, which stores fermented food, disclosed in Korean Patent Laid-open Publication No. 10-2007-0102195 (published: 18 Oct. 2007).

Herein, the pressing plate is placed so as to come into contact with the surface of the fermented food such that the air contact with the fermented food surface is blocked by the pressing plate, preventing the spoilage of the fermented food surface, if the air is introduced through a gap between the cover and the main body.

However, since the prior art pressing plate is just placed on the surface of the fermented food, the pressing plate is easily moved when an impact and the like are applied from the outside to the main body. Therefore, the prior art pressing plate has a problem that, if the pressing plate is turned over or sunk in the fermented food, it is not possible to expect the spoilage prevention of the fermented food surface by the pressing plate.

For the reason described above, the container for keeping fermented food has been developed for preventing the spoilage of the fermented food surface due to the movement of the pressing plate by restraining the movement of the pressing plate. However, no satisfactory result has been obtained until now.

SUMMARY OF THE INVENTION

Accordingly, the present invention has been made in view of this situation, and it is an objective of the present invention to provide a container for keeping fermented food so as to solve the above-mentioned problems occurring in the prior art, wherein the pressing plate is easily moved by an impact and the like applied from the outside to the main body and is thus turned over or sunk in the fermented food, such that the spoilage prevention of the fermented food surface by the pressing plate cannot be expected.

In order to achieve the above mentioned objective of the present invention, a container for keeping fermented food, according to the present invention, comprises: a main body for accommodating fermented food in an interior space; a pressing plate coming into contact with the surface of the fermented food in the main body; and a cover for blocking the opening of the inside of the main body; wherein the main body has a stepped part protruded inwards from the inner circumferential surface of a neck part at an upper end portion, and the pressing plate has a protruded rim provided to the periphery of the upper end portion thereof so as to be placed on the stepped part, a vertical section provided to the lower end of the protruded rim and having an outer circumferential surface coming into contact with the inner circumferential surface of the stepped part, and a round surface provided to the lower end of the vertical section and having a bottom surface part coming into contact with the surface of the fermented food.

The main body may be formed of polyethylene terephthalate.

The main body may be formed by an injection-blow molding method.

The stepped part may have a plurality of support parts, provided rising convexly in the upward direction from the top surface thereof at a uniform interval.

The pressing plate may be formed of any one of polyethylene terephthalate, polystyrene, polypropylene, high density polyethylene.

The pressing plate may be formed by a thermal forming method or an injection molding method The round surface has a protrusion part provided in the center thereof so as to be extended upwards.

The protrusion part has grooves formed to be depressed at both sides of the top surface thereof.

The round surface has a through hole provided in the lower end thereof.

A plurality of the through holes may be provided at an interval.

In the container for keeping fermented food according to the present invention, the protruded rim of the pressing plate is placed on the stepped part of the main body as well as the outer circumferential surface of the vertical section of the pressing plate comes into close contact with the inner circumferential surface of the stepped part of the main body such that the pressing plate is stably fixed in the main body. Therefore, the pressing plate is prevented from moving, even though an impact and the like are applied from the outside to the main body, such that the contact between the pressing plate and the fermented food surface may be continuously maintained and thus the spoilage prevention of the fermented food by the pressing plate may be stable.

BRIEF DESCRIPTION OF THE INVENTION

| Brief Explanation of Reference Symbol | |
|---|---|
| 10: main body | 11: neck part |
| 12: stepped part | 12a: support part |
| 20: pressing plate | 21: protruded rim |
| 22: vertical section | 23: round surface |
| 24: protrusion part | 24a: groove |
| 25: through hole | 30: cover |
| 100: fermented food | |
| A: container for keeping fermented food | |

DETAILED DESCRIPTION OF THE PREFERRED EMBODIMENT

Hereinafter, reference will be now made in detail to the preferred embodiment of the present invention with reference to the attached drawings.

Figure 1:
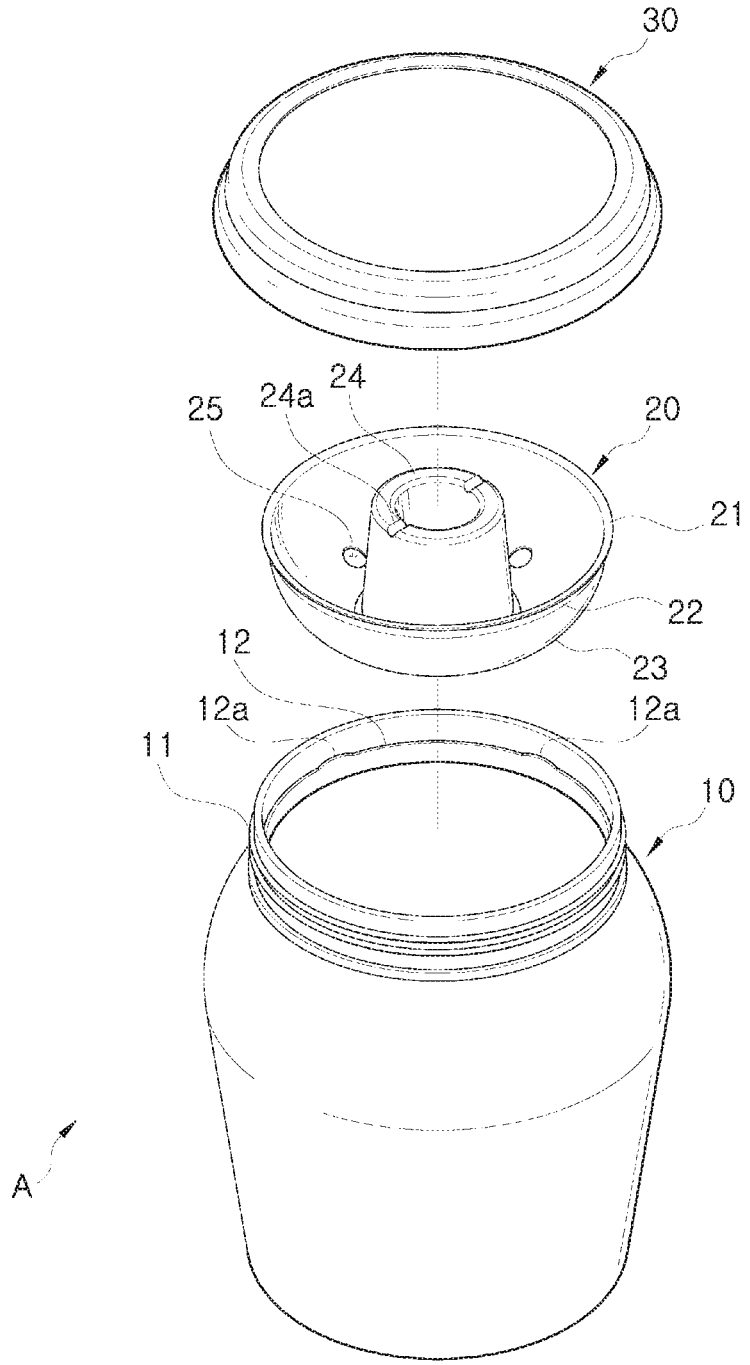
FIG. 1 is an exploded perspective view showing a container for keeping fermented food according to the present invention.
Figure 2:
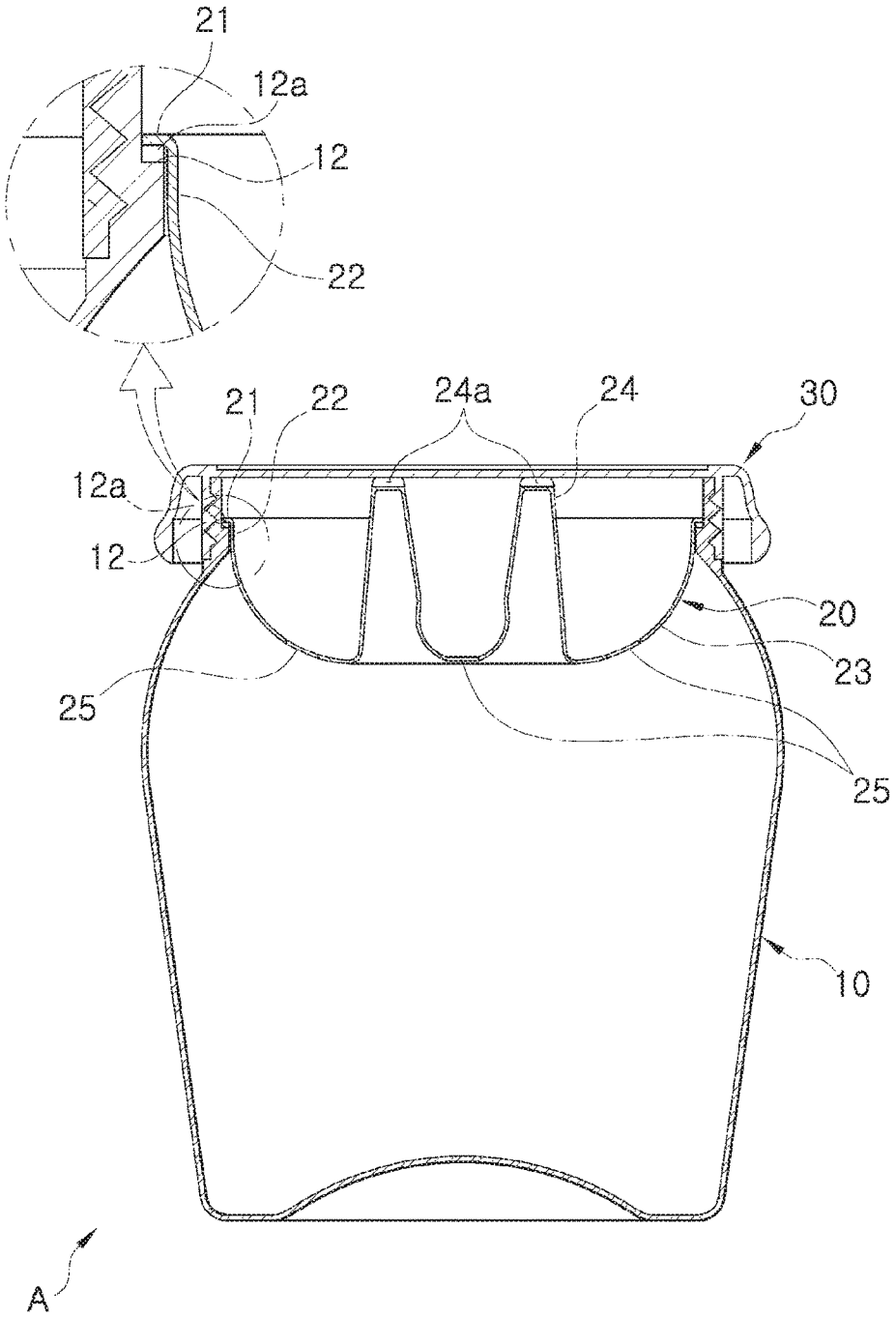
FIG. 2 is a cross sectional view for explaining the container for keeping fermented food according to the present invention, which is in a coupled state.

As shown in FIG. 1 and FIG. 2, a container for keeping fermented food A according to the present invention includes a main body 10, a pressing plate 20 and a cover 30.

The main body 10 accommodates fermented food 100 in the interior space thereof.

It is preferable that the above-mentioned main body 10 has a stepped part 12 protruded inwards from the inner circumferential surface of a neck part 11 at the upper end portion thereof.

Since the main body 10 is provided with the stepped part 12, on which a protruded rim 21, explained below, is placed when the pressing plate 20 is inserted to the inside of the main body 10, such that the pressing plate 20 is simply placed in the main body 10.

Figure 4:
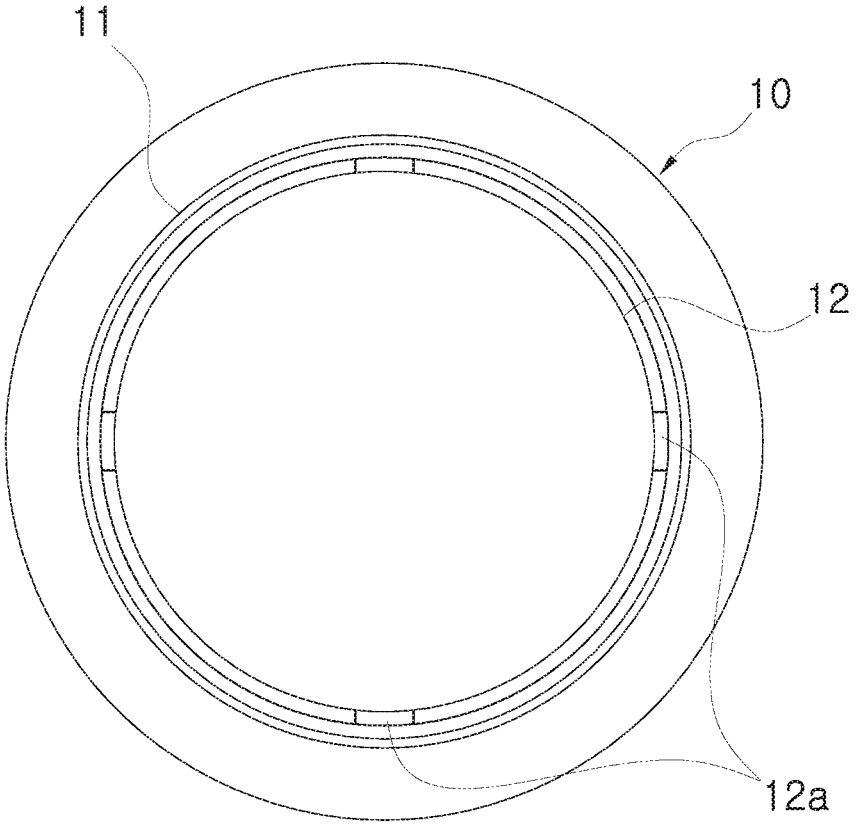
FIG. 4 is an exemplary view for illustrating the shape of a stepped part in the container for keeping fermented food according to the present invention.

Herein, the stepped part 12 may have a plurality of support parts 12*a*, which are provided rising convexly in the upward direction from the top surface thereof at a uniform interval, as shown in FIG. 4.

Since the stepped part 12 has the plurality of support parts 12*a*, the bottom surface of the protruded rim 21 is held on the upper end of the support part 12*a* and thus the bottom surface of the protruded rim 21 and the top surface of the stepped part 12 may be spaced from each other, preventing kimchi liquid, red pepper powder and the like from being caught between the bottom surface of the protruded rim 21 and the top surface of the stepped part 12.

Meanwhile, the main body 10 may be formed of polyethylene terephthalate.

Since the main body 10 is formed of polyethylene terephthalate, the main body 10 is not harmful to human bodies in view of the material characteristics thereof and the durability thereof is relatively stabilized.

In addition, the main body 10 may be formed by an injection-blow molding method.

Since the main body 10 is formed by the injection-blow molding method, the mass production of the main body 10 can be readily achieved in view of the characteristics of the method.

The pressing plate 20 comes into contact with the surface of the fermented food 100 in the main body 10.

It is preferable that the pressing plate 20 as above has the protruded rim 21 provided to the periphery of the upper end portion thereof so as to be placed on the stepped part 12.

Since the pressing plate 20 is provided with the protruded rim 21 and the protruded rim 21 is placed on the stepped part 12 as described above, the pressing plate 20 can be simply placed to the main body 10.

In addition, it is preferable that the pressing plate 20 has a vertical section 22, which is provided to the lower end of the protruded rim 21, such that the outer circumferential surface thereof comes into close contact with the inner circumferential surface of the stepped part 12.

Since the pressing plate 20 is provided with the vertical section 22, the outer circumferential surface of the vertical section 22 comes into contact with the inner circumferential surface of the stepped part 12 such that the movement of the pressing plate 20, which is placed to the main body 10, can be prevented in all directions.

Further, it is preferable that the pressing plate 20 has a round surface 23, which is provided to the lower end of the vertical section 22, such that the bottom surface part thereof comes into contact with the surface of the fermented food 100.

Since the pressing plate 20 is provided with the round surface 23, the bottom surface part of the round surface 23 comes into contact with the surface of the fermented food 100, preventing the surface exposure of the fermented food 100, such that the contact between the surface of the fermented food 100 and the air is prevented.

Herein, it is preferable that the round surface 23 has a protrusion part 24, which is provided in the center part thereof so as to be extended in the upward direction.

Since the round surface 23 is provided with the protrusion part 24, the upper end of the protrusion part 24 is pressed by the cover 30, the bottom surface part of the round surface 23 comes into close contact with the surface of the fermented food 100 and the pressing plate 20 can be readily withdrawn from the main body 10 by picking up the protrusion part 24.

Herein, it is preferable that the protrusion part 24 has grooves 24*a*, which are depressed downwards at both sides of the top surface thereof.

Since the protrusion part 24 is provided with the grooves 24*a*, the interior air of the main body 10 circulates through the grooves 24*a* such that the fermented food 100 is well-aged even though the top surface of the protrusion part 24 is in contact with the bottom surface of the cover 30.

Further, it is preferable that the round surface 23 has through holes 25, which are provided in the lower end part thereof.

Since the round surface 23 is provided with the through holes 25, the fermented food 100 which may possibly remain inside in the round surface 23 is discharged downwards through the through holes 25 when the pressing plate 20 is lifted. Therefore, it is possible to prevent any possible contamination of the fermented food 100, which may possibly remain inside the round surface 23, due to the exposure thereof to the outside during the withdrawal of the pressing plate 20.

Herein, it is possible to provide a plurality of the through holes 25 at intervals.

That is, the through holes 25 may be provided in the center and the periphery of the protrusion part 24.

Since the plurality of through holes 25 are provided at intervals, the fermented food 100 may be discharged downwards through each of the through holes 25 such that the discharge of the fermented food 100 may be smoothly carried out through the through holes 25.

Meanwhile, the pressing plate 20 may be formed of any one of polyethylene terephthalate, polystyrene, polypropylene and high density polyethylene.

Since the pressing plate 20 is formed of any one of polyethylene terephthalate, polystyrene, polypropylene and high density polyethylene, the durability thereof is relatively stabilized in view of the characteristics of the material.

In addition, the pressing plate 20 may be formed by a thermal forming method or an injection molding method.

Since the pressing plate 20 is formed by the thermal forming method or the injection molding method, the mass production of the pressing plate 20 can be achieved in view of the characteristics of the method.

The cover 30 blocks the opening of the inside of the main body 10.

The cover 30 as described above may have any normal structure and shape if such a cover 30 is coupled to the upper end of the main body 10 and can block the opening of the inside thereof. Therefore, the detailed explanation of the cover 30 is omitted.

Now, the use of the container for keeping fermented food A according to the present invention as described above will be described in detail hereinafter.

A predetermined amount of the fermented food 100 is accommodated in the main body 10 according to the present invention.

The pressing plate 20 is inserted into the main body 10 in a state, in which the fermented food 100 is accommodated in the main body 10.

Figure 3:
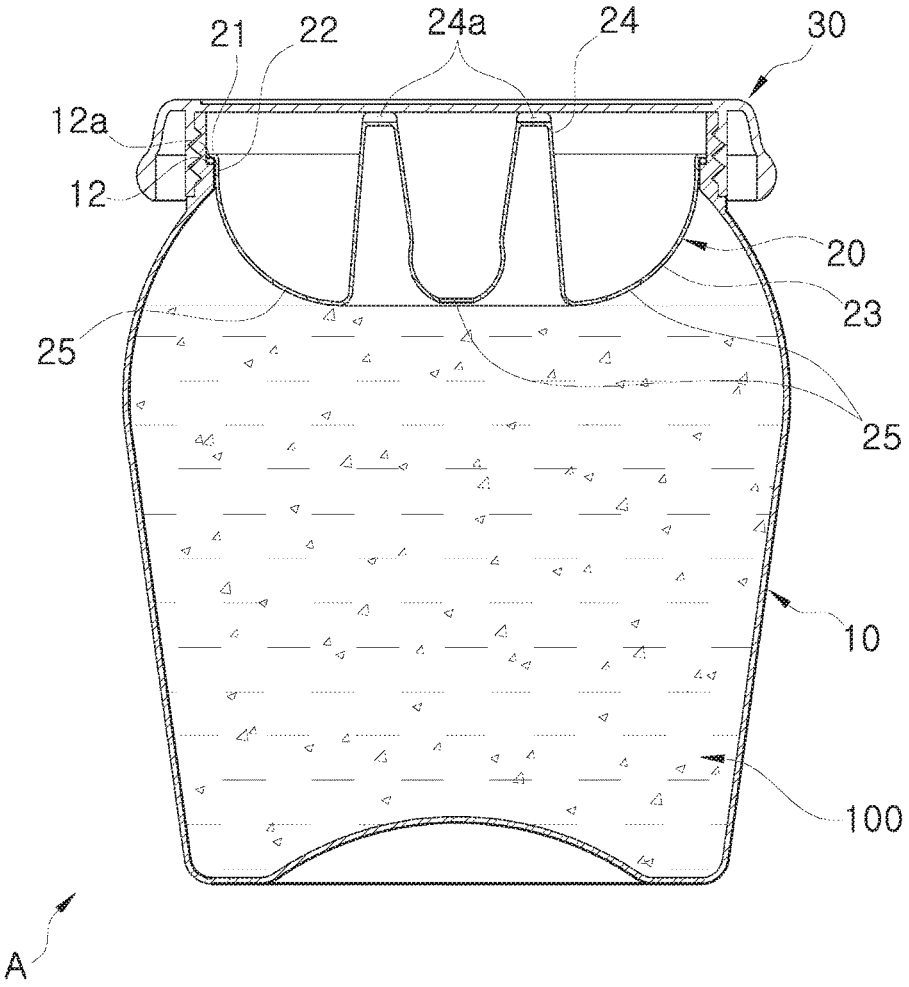
FIG. 3 is a view showing the container for keeping fermented food according to the present invention, which is in the state of use.

Herein, the pressing plate 20 inserted into the main body 10 comes into contact with the surface of the fermented food 100 at the bottom surface part thereof, as shown in FIG. 3. Therefore, the surface exposure of the fermented food 100 is blocked by the pressing plate 20 and thus the spoilage of the surface of the fermented food 100 due to the contact with the air is prevented.

However, if the pressing plate 20 is moved by an impact and the like applied thereto from the outside and is thus turned over or inserted into the fermented food 100, the spoilage prevention of the fermented food 100 surface by the pressing plate 20 cannot be expected.

However, according to the present invention, the pressing plate 20 is relatively stably fixed to the main body 10 in such a manner that the protruded rim 21 provided to the periphery of the upper end portion thereof is held by the stepped part 12 provided to the inner circumferential surface of the neck part 11 of the main body 10 as well as the outer circumferential surface of the vertical section 22 provided to the lower end of the protruded rim 21 comes into close contact with the inner circumferential surface of the stepped part 12. Therefore, even though an impact or the like is applied to the main body 10 from the outside, the movement of the pressing plate 20 is restrained such that the contact state between the bottom surface part of the pressing plate 20 and the surface of the fermented food 100 may be maintained and thus the spoilage prevention of the fermented food 100 surface by the pressing plate 20 is continued.

Meanwhile, according to the present invention, the pressing plate 20 can be readily withdrawn from the inside of the main body 10.

Figure 5:
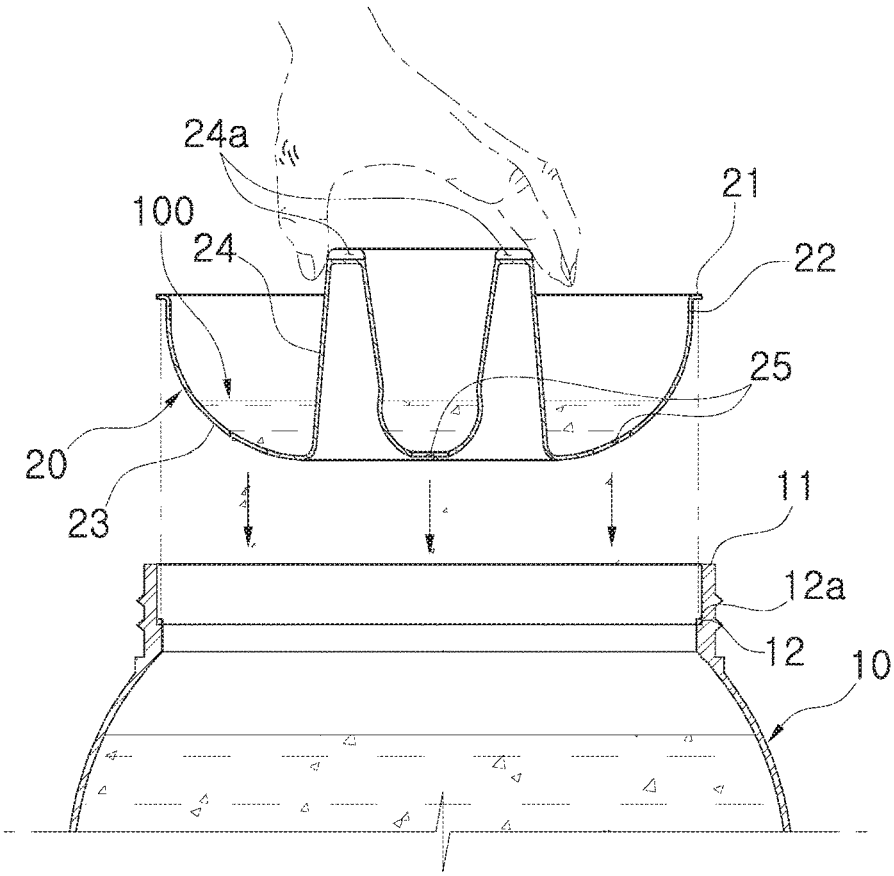
FIG. 5 is an exemplary view for explaining the withdrawal of a pressing plate in the container for keeping fermented food according to the present invention.
Figure 6:
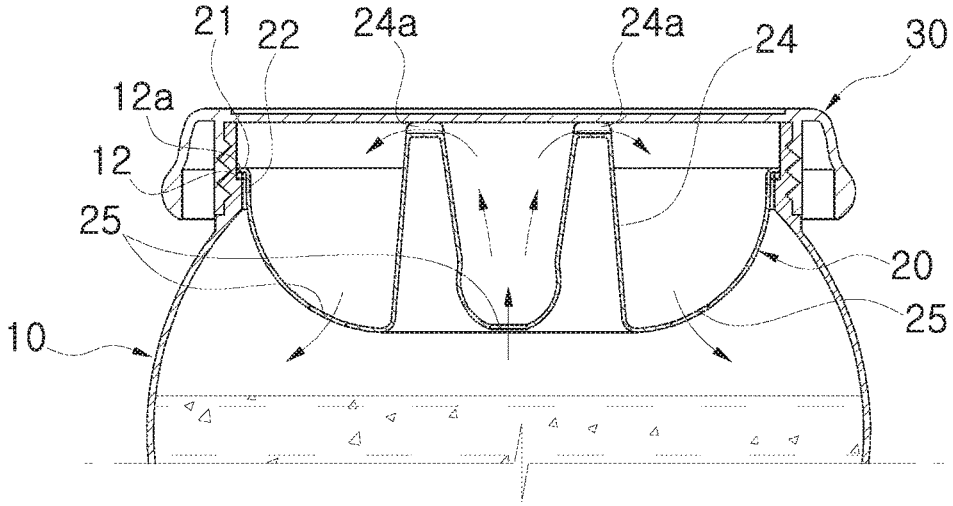
FIG. 6 is an exemplary view for explaining the air flow through the groove of a protrusion part in the container for keeping fermented food according to the present invention.

That is, according to the present invention, the round surface 23 has the protrusion part 24, which is provided in the center part thereof and extended in the upward direction, the pressing plate 20 can be readily withdrawn from the inside of the main body 10 as the protrusion part 24 is held and picked up, as shown in FIG. 5.

However, if the liquid and the like of the fermented food 100 remains inside the round surface 23 when withdrawing the pressing plate 20, the liquid and the like of the fermented food 100 may be leaked to the outside, contaminating the surroundings thereof.

However, according to the present invention, the round surface 23 has the through holes 25 provided to the lower end thereof, such that the liquid and the like of the fermented food 100 possibly remaining inside the round surface 23 can be discharged downwards, that is, to the inside of the main body 10, when picking up the pressing plate 20. Therefore, it is possible to prevent the contamination of the surroundings by the outside leakage of the fermented food 100 remaining inside the round surface 23 when withdrawing the pressing plate 20.

In the container for keeping fermented food A according to the present invention as described hereinabove, the pressing plate 20 is relatively stably fixed to the main body 10 in such a manner that the protruded rim 21 of the pressing plate 20 is held by the stepped part 12 of the main body 10 as well as the outer circumferential surface of the vertical section 22 of the pressing plate 20 comes into close contact with the inner circumferential surface of the stepped part 12 of the main body 10. Therefore, even though an impact or the like is applied to the main body 10 from the outside, the movement of the pressing plate 20 is restrained such that the contact between the pressing plate 20 and surface of the fermented food 100 is continuously maintained and thus the spoilage prevention of the fermented food 100 surface by the pressing plate 20 is stabilized.

As described above, it will be understood by those of ordinary skill in the art that the present invention is not limited to the above described embodiment and various changes, modifications and equivalents may be made therein without changing the essential characteristics and scope of the present invention. Therefore, it should be also understood that all modifications, changes and equivalences within the technical scope of the present invention defined by the following claims belong to the technical scope of the present invention.

What is claimed is:

1. A container for keeping fermented food, comprising:

a main body for accommodating fermented food in an interior space;

a pressing plate coming into contact with the surface of the fermented food in the main body; and a cover for blocking the opening of the inside of the main body;

wherein the main body has a stepped part protruded inwards from the inner circumferential surface of a neck part at an upper end portion, and the pressing plate has a protruded rim provided to the periphery of the upper end portion thereof so as to be placed on the stepped part, a vertical section provided to the lower end of the protruded rim and having an outer circumferential surface coming into contact with the inner circumferential surface of the stepped part, and a round surface provided to the lower end of the vertical section and haying a bottom surface part coming into contact with the surface of the fermented food, wherein the stepped part comprises a plurality of support parts, rising convexly in the upward direction from the top surface of the stepped part at a uniform interval.

2. The container for keeping fermented food according to claim 1, wherein the main body is formed of polyethylene terephthalate.

3. The container for keeping fermented food according to claim 2, wherein the main body formed by an injection-blow molding method.

4. The container for keeping fermented food according to claim 1, wherein the pressing plate is formed of any one of polyethylene terephthalate, polystyrene, polypropylene and high density polyethylene.

5. The container for keeping fermented food according to claim 4, wherein the pressing plate is formed by a thermal forming method or an injection molding method.

6. The container for keeping fermented food according to claim 1, wherein the round surface has a protrusion part provided in the center thereof so as to be extended upwards.

7. The container for keeping fermented food according to claim 6, wherein the protrusion part has grooves formed to be depressed at both sides of the top surface thereof.

8. The container for keeping fermented food according to claim 1, wherein the round surface has a through hole provided in the lower end thereof.

9. The container for keeping fermented food according to claim 8, wherein a plurality of through holes are provided at an interval.

* * * * *